US011460169B1

(12) United States Patent
Liu et al.

(10) Patent No.: US 11,460,169 B1
(45) Date of Patent: Oct. 4, 2022

(54) ELECTRONIC DEVICE WITH LOW PROFILE OPTICAL PLATE FOR OUTPUTTING VISUAL FEEDBACK

(71) Applicant: Apple Inc., Cupertino, CA (US)

(72) Inventors: Rong Liu, Sunnyvale, CA (US); Jun Qi, San Jose, CA (US); Victor H. Yin, Cupertino, CA (US); Yu P. Sun, Yorba Linda, CA (US); Meiting Wu, San Jose, CA (US); Paul J. Thompson, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/349,782

(22) Filed: Jun. 16, 2021

Related U.S. Application Data

(60) Provisional application No. 63/063,084, filed on Aug. 7, 2020.

(51) Int. Cl.

| | |
|---|---|
| ***F21V 7/09*** | (2006.01) |
| ***F21V 14/02*** | (2006.01) |
| ***F21V 33/00*** | (2006.01) |
| ***F21Y 115/10*** | (2016.01) |

(52) U.S. Cl.
CPC ..... *F21V 7/09* (2013.01); *F21V 14/02* (2013.01); *F21V 33/0056* (2013.01); *F21Y 2115/10* (2016.08)

(58) Field of Classification Search
CPC ..... F21V 14/02; F21V 33/0056; F21V 7/09; F21Y 2115/10; H01L 25/075–0753; H01L 33/52–56; G02F 1/133601–133611
See application file for complete search history.

(56) References Cited

U.S. PATENT DOCUMENTS

| | | | | |
|---|---|---|---|---|
| 8,985,814 | B2 | 3/2015 | King et al. | |
| 9,900,694 | B1 | 2/2018 | List | |
| 10,090,119 | B2 * | 10/2018 | O'Keeffe | H03K 17/962 |
| 10,470,276 | B2 | 11/2019 | Chen | |
| 2007/0254553 | A1 | 11/2007 | Wan | |

(Continued)

FOREIGN PATENT DOCUMENTS

| | | | |
|---|---|---|---|
| EP | 2991367 | B1 | 2/2020 |
| WO | 2019143903 | A1 | 7/2019 |

*Primary Examiner* — Britt D Hanley
(74) *Attorney, Agent, or Firm* — Treyz Law Group, P.C.; Jason Tsai

(57) ABSTRACT

An electronic device such as a voice-controlled speaker device may have a housing. A speaker and other input-output components and control circuitry may be mounted within the housing. Light-emitting components may emit light that passes through a curved upper top cap portion or other housing structure. Some of the light-emitting components may be rotated to improve color balance. Optical structures such as a dual-shot injection molded light control plate may be disposed over the light-emitting components to promote light mixing, reduce hotspots, and improve contrast on the top cap. The light control plate may have an upper clear layer with bell-shaped cavity portions configured to help spread light in the lateral direction and may have a reflective lower layer with dish-shaped portions configured to reflect and diffuse light back towards the top cap. The surface of the dish-shaped portions may be provided with microtextured structures to help scatter light.

23 Claims, 9 Drawing Sheets

(56) References Cited

U.S. PATENT DOCUMENTS

| | | | | |
|---|---|---|---|---|
| 2017/0059937 | A1* | 3/2017 | Kim | F21V 11/16 |
| 2018/0299972 | A1 | 10/2018 | Saito | |
| 2019/0026056 | A1* | 1/2019 | Wang | G06F 1/1633 |
| 2019/0347119 | A1 | 11/2019 | Tokuchi | |
| 2020/0019019 | A1* | 1/2020 | Liu | G02F 1/133609 |

* cited by examiner

ELECTRONIC DEVICE WITH LOW PROFILE OPTICAL PLATE FOR OUTPUTTING VISUAL FEEDBACK

This application claims priority to U.S. provisional patent application No. 63/063,084 filed Aug. 7, 2020, which is hereby incorporated by reference herein in its entirety.

FIELD

This relates generally to electronic devices and, more particularly, to electronic devices with light-emitting devices.

BACKGROUND

Electronic devices such as voice-controlled assistant devices may include light-emitting components. During operation, the light-emitting component may emit patterns of light that serve as visual feedback. The feedback helps confirm to a user that an electronic device is operating as desired.

It can be challenging to incorporate light-emitting components into an electronic device. If care is not taken, the patterns of light that are emitted will not appear as intended, the appearance of the device may not be as desired, or the device may be overly bulky.

SUMMARY

An electronic device such as a voice-controlled speaker device may have a housing. A speaker, other input-output components, and control circuitry may be mounted within the housing. During operation, the control circuitry can direct a set of light-emitting components to emit light that passes through the housing. The emitted light may, as an example, serve as visual feedback to confirm that a voice command or other input has been received from a user.

The housing may have an upper housing wall that overlaps the light-emitting components. The upper housing wall, which may sometimes be referred to as a top cap (or top cap portion), may be formed from a curved transparent, translucent (i.e., semi-transparent), or semi-translucent material. In one suitable arrangement, an array of light-emitting components may be formed on a planar printed circuit. A light control plate (or structure) may be formed over the light-emitting components. The light control plate may include a transparent upper layer and a reflective lower layer. The transparent upper layer may include recesses having concave downward portions aligned with the light emitting components. The recessed portions may be surrounded by concave upward dish-shaped surfaces formed at the interface of the upper and lower layers.

The recessed portions may be configured to direct light upwards to the top cap portion and to also spread light in the lateral direction so that the emitted light is uniformly projected across the surface of the top cap with sufficient contrast. The dish-shaped portions may be configured to reflectively scatter light that is total internally reflected off the top surface of the transparent upper layer back towards the top portion of the housing. The upper layer may also be configured to channel light, via total internal reflection, laterally towards a peripheral edge of the light control plate to ensure that the top cap is illuminated from one edge to another. The transparent upper layer may be a clear molded polymer layer, and the reflective lower layer may be a white co-molded polymer layer.

If desired, the surface of the dish-shaped regions may optionally be provided with microstructures or nanostructures configured to scatter light while minimizing specular reflections. In some embodiments, the light control plate may have a patterned reflective coating lining the dish-shaped regions instead of the molded lower layer. One or more diffuser layers may be mounted between the top cap and the light control plate.

DETAILED DESCRIPTION

Electronic devices may have light-emitting devices. A light-emitting device may be used to provide a user with visual feedback during operation of an electronic device. For example, in a voice-controlled device, visual feedback such as moving patterns of lights of different colors may be used to visually confirm to the user that the voice-controlled device is responding to a voice command. Visual output may also include status indicator information and other output.

Figure 1:
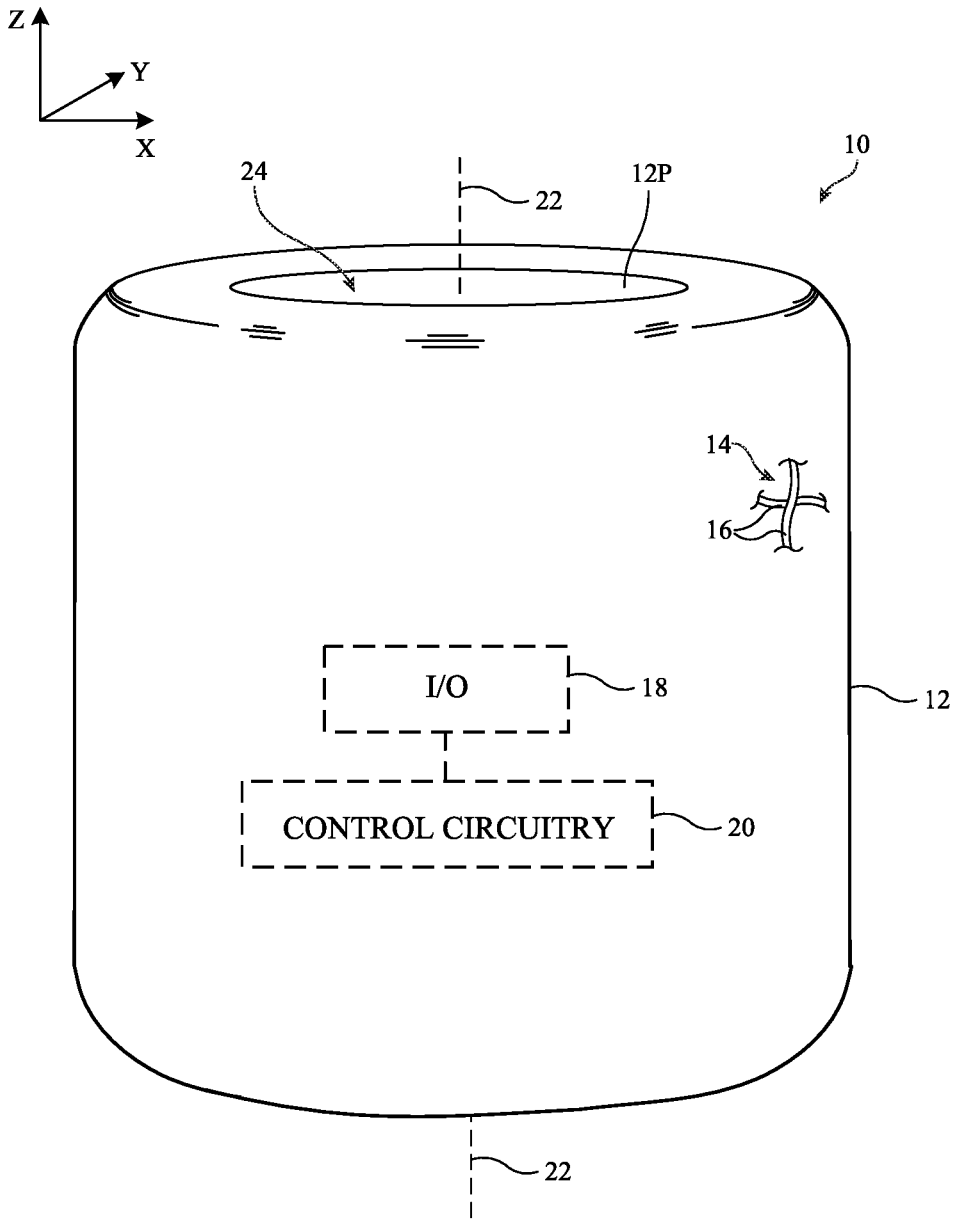
FIG. 1 is a perspective view of an illustrative voice-controlled electronic device having a visual feedback output device in accordance with an embodiment.

FIG. 1 is a perspective view of an illustrative electronic device 10 that includes a light-emitting device 24 to provide visual output. Light-emitting device 24 for outputting visual feedback responsive to a user's voice command may therefore sometimes be referred to herein as a visual feedback output device. In the example of FIG. 1, device 10 is a voice-controlled device such as a voice-controlled counter-top speaker. If desired, device 10 may be an electronic device or an accessory for an electronic device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which equipment for device 10 is mounted in a kiosk, in an automobile, airplane, or other vehicle, other electronic equipment, or equipment that implements the functionality of two or more of these devices.

As shown in FIG. 1, device 10 may include a housing such as housing 12. Housing 12 may have a cylindrical shape with rounded upper and lower ends of the type shown in FIG. 1 or other suitable shape (e.g., a pyramidal shape, a conical shape, a frustoconical shape, a box shape such as a rectangular box shape, a spherical shape, a hemispherical shape, a dome shape, etc.). Device 10 may have rotational symmetry about vertical axis 22 that is parallel with the Z direction (e.g., device 10 may have a circular, oval, triangular, rectangular, pentagonal, hexagonal, or other polygonal cross-section with a center that is aligned with axis 22). Housing 12 may include support structures formed from metal, polymer, ceramic, glass, wood, quartz, fiber composite, other materials, and/or combinations of these materials. The shape of housing 12 may be selected to form an enclosure suited to the type of device 10 for which the housing is being used.

As an example, in scenarios in which device 10 is a voice-controlled electronic device, housing 12 may be cylindrical, pyramidal, box-shaped, conical, spherical, or other shapes suitable for enclosing one or more speakers; in configurations in which device 10 is a laptop computer, housing 12 may have upper and lower thin box-shaped portions that are joined with a hinge and that can respectively house a display and a keyboard; in configurations in which device 10 is a computer monitor containing an embedded computer, housing 12 may have a slender box shape with optionally curved rear housing walls that can hold a display and be mounted on a stand; in configurations in which device 10 is a tablet computer, cellular telephone, media player, or other handheld or portable electronic device, housing 12 may have a rectangular outline and a thin depth; in configurations in which device 10 is a smaller device such as a wristwatch device or a pendant device, housing 12 may have a thin profile and an outline that is rectangular, square, hexagonal, triangular, oval, or circular; in configurations in which device 10 is a headphone or earpiece device, housing 12 may have a shape configured to fit on or in a user's ear; in configurations in which device 10 is a pair of eyeglasses or other equipment worn on a user's head, housing 12 may have a head-mountable shape; in configurations in which device 10 is a jacket or other item of clothing (e.g., a hat, belt, wrist band, arm band, headband, ring, necklace, shirt, pants, shoes, glove, etc.), housing 12 may be formed from layers of fabric or other material configured to allow device 10 to be worn on a user's body; in configurations in which device 10 is a television, a computer display that does not contain an embedded computer, a gaming device, or a navigation device, housing 12 may have a rectangular outline, an outline with curved sides and/or straight sides, a box shape, a cylindrical shape, and/or other suitable shapes; in configurations in which device 10 is a kiosk, housing 12 can form a pedestal or other shape suitable for a kiosk; in configurations in which device 10 forms part of an automobile, airplane, or other vehicle, housing 12 may form a dashboard, console, door, window, seat, body panel, or other portion of the vehicle; in configurations in which device 10 is a removable external case for electronic equipment, housing 12 may have the shape of a sleeve or other structure with a recess for receiving the electronic equipment; in configurations in which device 10 is a strap, wrist band, necklace or headband, housing 12 may have a strip shape, in configurations in which device 10 forms a case, bag, or wallet, housing 12 may have surfaces that form the walls of the case and/or sides of the bag or wallet and/or that forms straps and/or other structures for the case or bag; and in configurations in which device 10 is part of furniture, housing 12 may be configured to form a part of a chair, sofa, or other seating (e.g., cushions or other seating structures). In the illustrative configuration of FIG. 1, housing 12 has a cylindrical shape suitable for an electronic device such as a voice-controlled speaker with internet access. Housing 12 may have other shapes and may be incorporated into other devices, if desired. The configuration of FIG. 1 is presented as an example.

If desired, device 10 may include fabric 14. Fabric 14 may form all or part of a housing wall or other layer in an electronic device, may form the outermost layer of device 10, may form one or more inner covering layers, may form internal structures in an electronic device, or may form other fabric-based structures. Device 10 may be soft (e.g., device 10 may have a fabric surface that yields to a light touch), may have a rigid feel (e.g., the surface of device 10 may be formed from a stiff fabric), may have a surface that is textured, that is smooth, that has ribs or other patterned textures, and/or may include portions formed from non-fabric structures of plastic, metal, glass, crystalline materials, ceramics, or other materials.

Fabric 14 may include intertwined strands of material such as strands 16. Fabric 14 may, for example, include warp knit fabric that is formed by warp knitting of strands 16 and/or may include woven fabric, fabric with braided strands of material, etc. Strands 16 may be single-filament strands (sometimes referred to as fibers or monofilaments) or may be strands of material formed by intertwining multiple monofilaments of material together (sometimes referred to as yarns).

Strands 16 may be formed from polymer, metal, glass, graphite, ceramic, natural materials such as cotton or bamboo, or other organic and/or inorganic materials and combinations of these materials. Conductive coatings such as metal coatings may be formed on non-conductive material. For example, plastic strands in fabric 14 may be coated with metal to make them conductive. Reflective coatings such as metal coatings may be applied to make strands reflective. Strands formed from white polymer (e.g., light-scattering particles in polymer) and/or that are coated with white polymer may help reflect light in some configurations. Darkly colored strands may also be used. If desired, strands may be formed from bare metal wires or metal wire intertwined with insulating monofilaments (as examples). Bare metal strands and strands of polymer covered with conductive coatings may be provided with insulating polymer jackets. In some configuration, strands 16 may include optical fibers.

In an illustrative configuration, some or all of the upper surface of housing 12 such as portion 12P may be formed from rigid polymer, rigid glass, or other non-fabric structure and the sidewall surfaces of housing 12 may be covered with fabric 14 (e.g., to create a cover layer for the sidewalls that is transparent to sound). Portion 12P, which may sometimes be referred to as an upper housing wall or top cap, may be a disk. For example, portion 12P may be formed from a disk-shaped polymer or glass member with a slightly curved cross-sectional profile and a circular outline (e.g., portion 12P may form a slightly protruding dome shape or other suitable housing shapes). Portion 12P may be formed from transparent materials. The transparent materials may be translucent (hazy) or may exhibit low haze. Portion 12P may, as examples, have an amount of haze that only transmits a portion of the light projected from output device 24 (e.g., to transmit no more than 90% of the incident light, to transmit no more than 80% of the incident light, to transmit no more than 70% of the incident light, to transmit no more than 60% of the incident light, to transmit no more than 50% of the incident light, to transmit no more than 40% of the incident light, to transmit no more than 30% of the incident light, etc.). The use of translucent material, semi-translucent material, and/or other transparent material for portion 12P allows underlying light-emitting components such as visual feedback output device 24 in the interior of device 10 to project a desired pattern of light onto portion 12P. For example, portion 12P may be formed from clear material, material with a neutral tint (e.g., dark polymer or glass that allows light to pass), or material with a non-neutral color (e.g., blue, red, etc.).

Figure 3A:
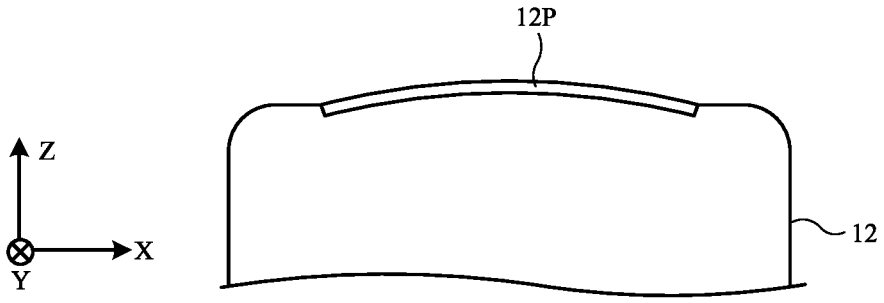
FIGS. 3A, 3B, and 3C are side views of a top housing portion of the electronic device of FIG. 1 in accordance with an embodiment.
Figure 3B:
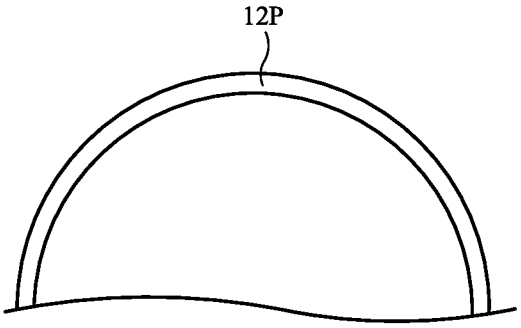
Figure 3C:
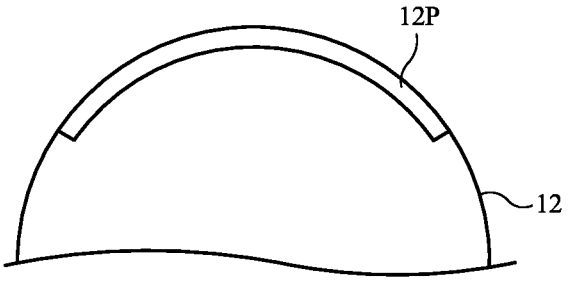

In one suitable arrangement, top cap portion 12P may have a curved surface that is attached to a cylindrical housing wall with rounded corners (see, e.g., cross section of FIG. 3A). This example in which portion 12P is a disk-shaped polymer with a curved surface is merely illustrative. If desired, portion 12P may have flat/planar upper surfaces. In another suitable arrangement of FIG. 3B, portion 12P may have a dome-like, hemispherical, or other substantially protruding profile. In the example of FIG. 3B, portion 12P may extend the entire width of the electronic device 10 such that the visual feedback output area is in contact with the lateral housing portion of device 10. In yet another suitable configuration of FIG. 3C, portion 12P having a dome-like, hemispherical, or other substantially bulging shape does not extend the entire width of device 10. Assuming the maximum housing width is constant, the visual output surface area of portion 12P in FIG. 3C may therefore be less than the visual output area of portion 12P in FIG. 3B.

Portion 12P may optionally overlap a touch sensor. For example, a two-dimensional capacitive touch sensor may be formed from an array of capacitive touch sensor electrodes that are overlapped by portion 12P. Capacitive touch sensor circuitry may be coupled to the touch sensor electrodes and may gather user touch input through portion 12P. The capacitive touch sensors may be formed directly on the inner surface of portion 12P, which therefore serves as a substrate for the touch sensors, or may be formed on separate supporting structures (e.g., a separate polymer film or other separate substrate). Capacitive touch sensor electrodes may be formed from conductive material such as metal, transparent conductive material such as indium tin oxide, or other conductive materials. If desired, one-dimensional, two-dimensional, and/or three-dimensional sensors such as proximity sensors, optical touch sensors, force sensors, image sensors, time-of-flight sensors, vibration sensors such as accelerometers, and/or other sensors may be formed under portion 12P or other portions of housing 12 (e.g., instead of a two-dimensional capacitive touch sensor or in addition to a two-dimensional capacitive touch sensor). If desired, sensors may operate through fabric sidewalls or other housing structures.

Device 10 may include control circuitry 20. Control circuitry 20 may include microprocessors, microcontrollers, application-specific integrated-circuits, digital signal processors, baseband processors, and/or other controllers and may include storage such as random-access memory, read-only memory, solid state drives, and/or other storage and processing circuitry.

Control circuitry 20 may gather information from sensors and other circuitry in input-output devices 18 and may use input-output devices 18 to supply output. Input-output devices 18 may, for example, include audio devices such as microphones and speakers. Microphones can gather audio input (e.g., sound that passes through fabric 14 such as voice commands for controlling the operation of device 10). Speakers can produce audio output (e.g., sound that passes through fabric 14). Sensors in input-output devices 18 may include touch sensors, force sensors, capacitive sensors, optical sensors, proximity sensors, strain gauges, temperature sensors, moisture sensors, gas sensors pressure sensors, magnetic sensors, position and orientation sensors (e.g., accelerometers, gyroscopes, and/or compasses), and/or other sensors. Sensors such as these may, if desired, be overlapped by housing portion 12P (e.g., a polymer layer or glass layer).

Light-emitting diodes, displays, and other visual output devices may be used in supplying visual output to a user. As an example, visual output devices may be used to form illuminated buttons (e.g., volume control indicators), displays that display images, visual feedback areas that display still and/or moving patterns of swirling light to indicate to a user that a command has been received and/or is being processed by control circuitry 20, etc. Commands may be received using a touch sensor, voice commands may be received by control circuitry 20 using a microphone in input-output devices 18, and other input may be received using input-output devices 18. If desired, buttons, joysticks, haptic output components, and/or other input-output components may be provided in input-output devices 18 to gather input from a user and to provide a user with output. Wireless circuitry in circuitry 20 (e.g., wireless local area network circuitry, cellular telephone circuitry, etc.) may be used to support wireless communications with external equipment (e.g., to form a communications link with internet-based equipment or other electronic equipment).

Light-emitting components (e.g., lasers or light-emitting diodes) may be arranged in a pattern under portion 12P of housing 12 or other suitable portion of housing 12. In general, any suitable light-based output may be supplied by light-based output devices in device 10. For example, displays with arrays of pixels may display images, text output devices such as segmented light-emitting diode displays may display text, and status indicator lights may provide light output indicative of device operating status (e.g., a power on/off status, battery level status, volume level status, mute/non-muted status, etc.). In an illustrative arrangement, which may sometimes be described as an example, a light-emitting device in device 10 is formed from a set of discrete light-emitting components that are located under housing portion 12P. The light-emitting device 24 may be used to provide status information, decorative patterns, visual feedback (e.g., confirmation of receipt by control circuitry 20 of device 10 of voice commands), and/or other visual information that is visible through portion 12P.

Figure 2:
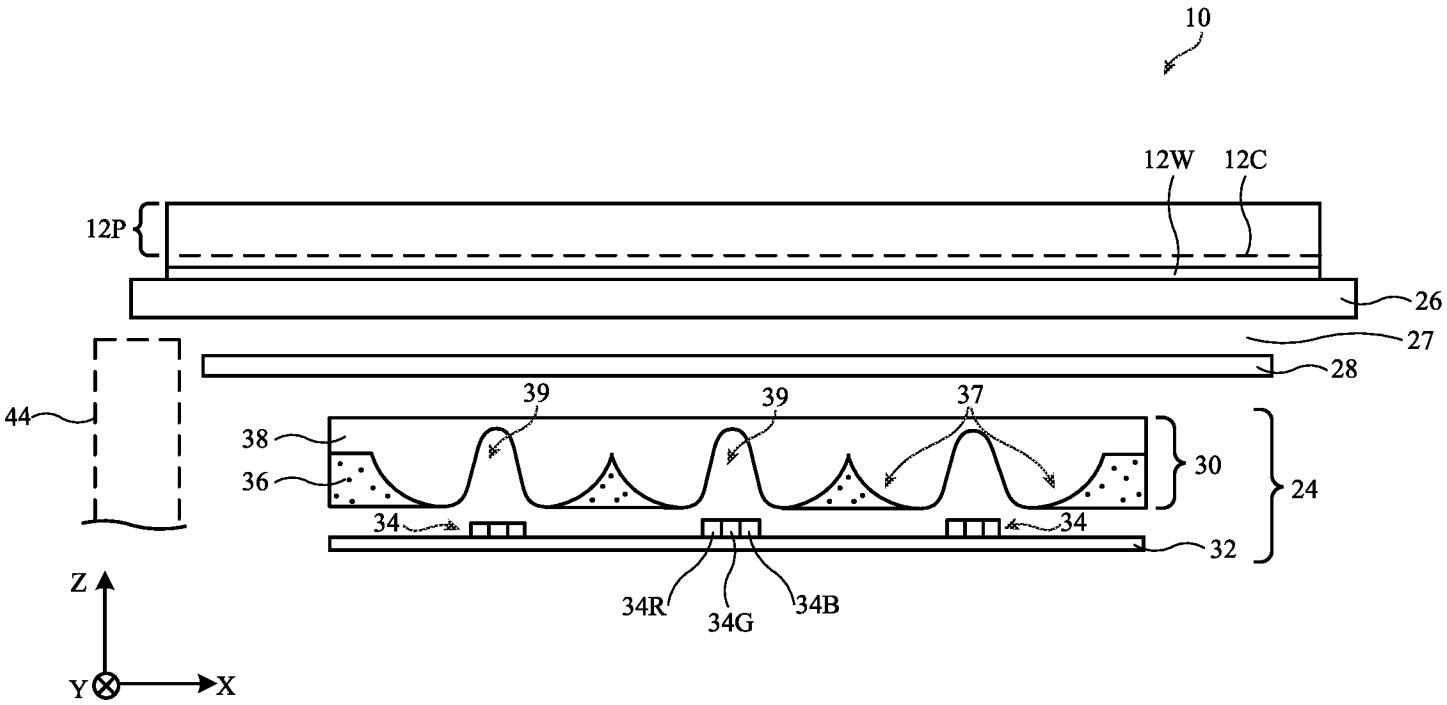
FIG. 2 is a cross-sectional side view of a portion of the electronic device of FIG. 1 having light-emitting components and an illustrative light control plate over the light-emitting components in accordance with an embodiment.

To help enhance the appearance of visual output provided through top cap portion 12P, the light-emitting device 24 may include light-spreading structures. The light-spreading structures may include one or more layers of optical structures that spread and mix light in lateral directions such as directions in the X-Y plane as light propagates outward (e.g., upwardly in the Z direction) from light-emitting components located under portion 12P. A cross-sectional side view of a portion of device 10 in the vicinity of housing portion 12P in an illustrative configuration in which light-emitting components are overlapped by a light control plate is shown in FIG. 2. As shown in FIG. 2, a semi-opaque white layer such as layer 12W may be painted or otherwise formed at the bottom surface of top cap portion 12P. In the example where portion 12P is formed from clear material, layer 12W may be formed directly on the bottom surface of top cap 12P. In the example where portion 12P is formed from a darker tint material, a color adjustment layer 12C may optionally be interposed between top cap portion 12P and layer 12W to fine tune the tint of portion 12P as viewed by the user. A clear window layer such as transparent window layer 26 may be formed directly below 12P. Window 26 may be formed from clear polymer or other transparent material. If desired, a touch sensor with touch sensor electrodes may be formed at either the top or bottom surface of clear window 26.

Light-emitting components 34 may be mounted on a planar printed circuit 32 (e.g., a printed circuit board or PCB). Printed circuit 32 may be coplanar with the X-Y plane. Printed circuit 32 may contain signal lines that convey signals from control circuitry 20 to components 34 so that components 34 may emit desired amounts of light. The color of emitted light may be controlled by adjusting the emitted color from each of components 34.

With an illustrative configuration, each component 34 contains components such as red light-emitting component 34R (e.g. a red light-emitting diode or red laser), green light-emitting component 34G (e.g., a green light-emitting diode or green laser), and blue light-emitting component 34B (e.g., a blue light-emitting diode or blue laser). With this type of configuration, the color of light that is emitted can be adjusted by adjusting the relative light intensity from each of the colored subcomponents of each light-emitting component 34. The pattern of light that is emitted (e.g., the location in the X-Y plane of the emitted light) can be controlled by controlling components 34 (e.g., to turn on a first component 34 on the left side of device 10 while turning off a component 34 on the right side of device 10, to display blue light from one component and red from another, to display a pattern with a gradient of light intensity, etc.). If desired, flashing light effects, chasing light effects, lighting effects involving emission of light patterns that swirl or otherwise move about the X-Y plane of FIG. 2 may be produced.

A light control structure such as light control plate 30 may be formed over and may overlap the array of light-emitting components 34. Light control plate 30 may be considered as a part of visual output device 24 or may sometimes be considered a separate component. Light control 30 may include at least two layers. In the example of FIG. 2, light control plate 30 includes an upper transparent (clear) layer 38 and a lower reflective base layer 36. Upper layer 38 may include an array of recessed portions 39 each of which is aligned with a respective one of the light-emitting components below. Each recess 39 may have a concave surface portion with a center or principal axis aligned with one of the light-emitting components (e.g., each recessed portion 39 is concave downward or has a downward facing curvature). Each recessed portion 39 may form a cavity or an air gap that is devoid of filler material over each respective light-emitting diode. Recess 39 may have a bell-shaped profile, a parabolic profile, a hemispherical profile, a dome-like profile, a conical profile, a frustoconical profile, a pyramidal profile, or other suitable curved profile. Each recess 39 within optical plate 30 may also sometimes be referred to as a locally depressed region, a recessed region, a sunken region, an indented region, a cavity region, etc. Light emitted from a light-emitting component 34 may travel through the air gap surrounded by an associated bell-shaped recess 39 and may directly enter the curved surface of that recessed cavity 39. The curved surface of recess 39 may be configured to direct light in the upwards direction (i.e., in the Z direction) while also mixing and spreading light in the lateral direction (i.e., along the X-Y plane). Each recess 39 may therefore sometimes be referred to as a lens structure. Layer 38 may be a solid molded (or machined) layer of transparent material (e.g., clear polymer, clear polycarbonate, clear plastic, clear resin, etc.) or may be formed using separate components (e.g., using a transparent layer separately attached to concave sunken features in a desired pattern using a frame). Configurations in which layer 38 is a molded layer with integrated recessed regions may sometimes be described herein as an example.

Lower (base) layer 36 may have an array of dish-shaped regions 37 each of which is aligned with and surrounds a respective one of the recesses 39. Each dish-shaped portion 37 of layer 36 may have a through hole that is aligned with a respective one of the recessed regions 39. Each dish-shaped portion 37 of the lower layer 36 may therefore surround a corresponding recessed portion 39 of the clear upper layer 38. The dish-shaped portion 37 of layer 46 may be filled with the transparent material of upper layer 38. Each dish-shaped portion 37 may have a parabolic profile, a concave profile, a crater-like profile, or other suitable curved profile. In contrast to recesses 39, dish-shaped portion 37 has an upward facing curvature (e.g., the interface between layer 36 and 38 is concave upward). The curvature of the surface of the dish-shaped regions 37 may generally be shallower than the curvature of the surface of the hollow bell-shaped recessed regions 39 (e.g., the curvature of the cavity wall may be steeper than the curvature of the dished surface).

Light emitted from a light-emitting component 34 may traverse layer 38 as described above but may (when striking the upper surface of layer 38 at an angle that is equal to or greater than a critical angle) sometimes reflect back towards the light-emitting components via total internal reflection. Base layer 36 may be a solid molded (or machined) layer of reflective material (e.g., white polymer, white plastic, white resin, etc.) or other suitable diffusive and reflective material. Configured in this way, any light reflecting back down towards the dished surfaces 37 can be reflected back upwards in the intended Z direction. The use of a white (or other bright) layer to reflect light can help provide a diffused reflection with minimal specular (mirror-like) reflection. In general, base layer 36 may be formed using any diffusive reflective material. As an example, layer 36 may be a polymer layer or other substrate that is optionally lined with textured coating layer(s) (e.g., with textured structures such as pyramidal structures, spherical structures, conical structures, frustoconical structures, ridges, and/or other protrusions, and/or grooves, pits, or other depressions to help scatter light). Layer 36 may optionally contain light-scattering structures embedded in polymer or other reflective material. The light-scattering structures may include voids (e.g., vacuum-filled cavities, gas-filled cavities such as air bubbles, cavities filled with nitrogen or other inert gases, etc.) and/or may include or be doped with light scattering particles with different refractive index values. The light-scattering particles may include, for example, titanium dioxide particles or other particles of inorganic dielectric.

Configurations in which layers 36 and 38 are molded (or co-molded) using dual-shot plastic injection techniques may sometimes be described herein as an example. Dual-layer light control plate 30 co-molded in this way may be configured to promote light mixing, to reduce hotspots, and to improve contrast on the top cap 12P. Manufacturing light control plate 30 composed of at least two different materials (e.g., a clear material in the upper layer and a reflective material in the lower layer) using a multi-shot plastic molding process can also enable plate 30 to have a relatively small thickness (i.e., a small Z height), thereby reducing the entire optical stack of the light output device 24 and freeing up additional space within device 10 to accommodate other components.

Still referring to FIG. 2, a light diffuser layer such as light diffusing layer 28 may be formed over plate 30. Light diffuser layer 28 may be considered a part of light emitting device 24 or may be considered a separate component within device 10. In one suitable arrangement, diffuser layer 28 may have a flat bottom surface and a curved top surface. In another suitable arrangement, diffuser layer 28 may have curved bottom and top surfaces. In yet another suitable arrangement, diffuser layer 28 may have flat bottom and top surfaces. Diffuser layer 28 may be configured to diffuse, scatter, mix, and/or otherwise homogenize the light that is emitted from the array of light-emitting components 34 and passing through light control plate 30. Layer 28 may be a transparent polymer layer or other substrate that is optionally coated with textured coating layer(s) (e.g., with textured structures such as pyramidal structures, spherical structures, conical structures, frustoconical structures, ridges, and/or other protrusions, and/or grooves, pits, or other depressions to help scatter light). Layer 28 may optionally contain light-scattering structures embedded in glass, polymer, or other transparent material. The light-scattering structures may include voids (e.g., vacuum-filled cavities, gas-filled cavities such as air bubbles, cavities filled with nitrogen or other inert gases, etc.) and/or may include light scattering particles with different refractive index values as the transparent material. The light-scattering particles may include, for example, titanium dioxide particles or other particles of inorganic dielectric.

Air gap 27 may separate diffuser layer 28 and clear window 26. The presence of air gaps may help promote light mixing for light projected from the light-emitting components onto the surface of portion 12P. For example, the vertical gap distance between clear layer 26 and diffuser layer 28 and/or the thickness of diffuser layer 28 may be tuned to optimize for light and color uniformity across the surface of portion 12P. If desired, diffuser layer 28 and light control plate 30 might also be separated by an air gap, and the vertical gap distance between diffuser layer 28 and plate 30 may also be tuned to optimize for light and color uniformity across the surface of portion 12P. If desired, one or more additional light diffusing or scattering layers may also be disposed in the air gap between layers 26 and 28 and/or in the air gap between layers 28 and 30 to further homogenize emitted light, reduce undesired optical artifacts, and reduce hotspots on top caption portion 12P. The various layers 26, 28, 30, and 32 within the housing of device 10 may be supported or held in place using associated support structure 44 within the device housing.

Figure 4:
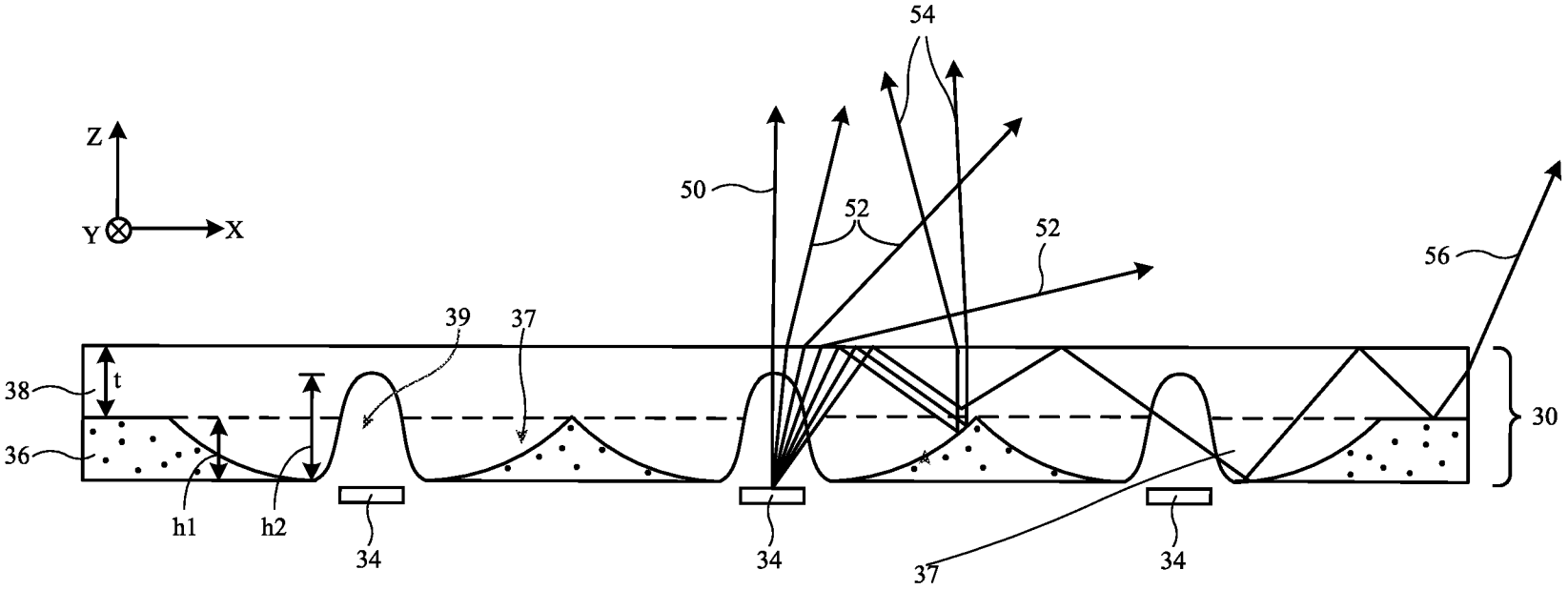
FIG. 4 is a cross-sectional side view of an illustrative light control plate having an upper transparent layer with an array of concave bell-shaped cavities and a lower reflective base layer with an array of concave dish regions aligned to the bell-shaped cavities in accordance with an embodiment.

FIG. 4 is a cross-sectional side view of light control plate 30. As shown in FIG. 4, an array of light-emitting components 34 may be formed below light control plate 30. Light control plate 30 may include a hollow bell-shaped recess 39 that forms a cavity over each light-emitting component 34. Light-emitting component 34 may be oriented within the house of device 10 to project light primarily upwards in the Z direction towards housing portion 12P. Component 34 may emit light traveling straight up and normal to the top surface of layer 38 as shown by ray path 50. Light ray 50 may strike the vertex (principle axis) or the center of each bell-shaped recess. At least some of the light emitted from component 34 will not travel straight up but will instead strike the lateral curved surface of recess 39 as shown by ray path 52. The curvature of recess 39 may direct light ray 52 to bend outwards when exiting the top surface of layer 38. The shape, size, and curvature of recess 39 and/or the thickness t of layer 38 may be tuned to provide the desired amount of light mixing and angular spread for light exiting from plate 30. Yet another portion of the light emitted from component 34 may strike the upper surface of layer 38 at an incident angle that is greater than or equal to the critical angle (see, e.g., some of the emitted light entering the convex surface portion of the recess). Some of the reflected light may travel down towards the parabolic reflective dish-shaped surfaces 37, which is then diffusively scattered back up in the Z direction as shown by ray path 54. The interface between layer 38 and 36 serves as the dish-shaped surfaces 37. Some of the reflected light may travel laterally across layer 38, via the principal of total internal reflection, and may exit or be otherwise extracted at a peripheral edge of layer 38 as shown by ray path 56. Spreading light using light control plate 30 in this way can help achieve improved contrast in the emission light patterns as well as uniformity across the entire visual output surface of housing portion 12P. Also shown in FIG. 4, the overall height h2 of each recessed portion may be greater than the height h1 of each dish-shaped portion (e.g., the dish-shaped regions have height h1 that is equal to the thickness of layer 36, whereas the bell-shaped cavity regions have height h2 that extends from the bottom surface of layer 36 to above the top surface of layer 36). If desired, the height of each cavity portion 39 might be equal to or less than the thickness of layer 36.

Figure 5:
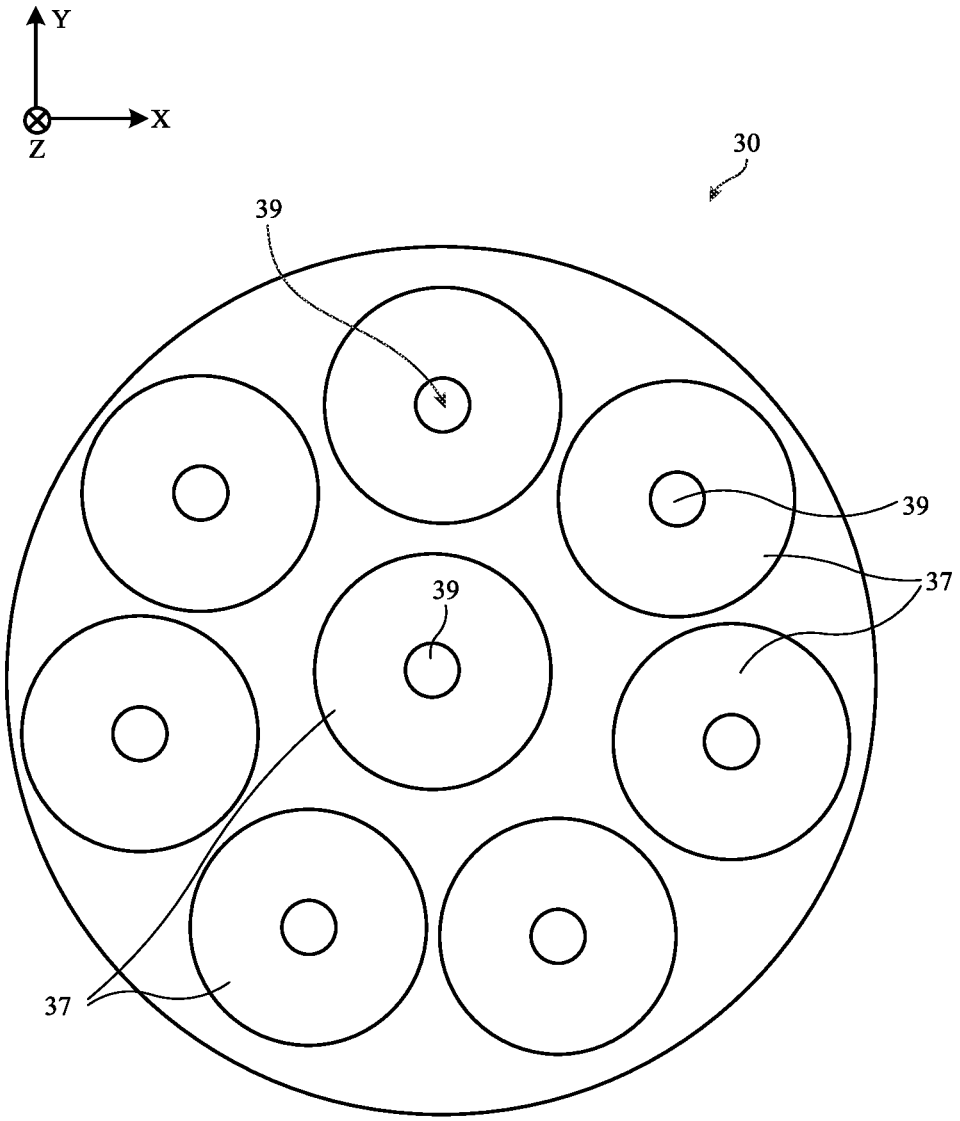
FIG. 5 is a top (plan) view of the illustrative light control plate of FIG. 4 in accordance with an embodiment.

FIG. 5 is a top (plan) view of light control plate 30. As shown by FIG. 5, light control plate 30 may include an array of hollowed recessed (cavity) regions 39 each of which is surrounded by a dish-shaped (e.g., parabolic) region 37. Light emitted from the light-emitting components may first travel through the surface of each region 39 formed from the clear transparent material of the upper layer 38 and any light that is reflected back down towards the dish-shaped regions 37 may be scattered back up. In the example of FIG. 5, each bell-shaped recessed region 39 and parabolic dish region 37 has a circular footprint. This is merely illustrative. If desired, each recessed region 39 and/or dish region 37 may have an oval shape, an elliptical shape, a triangular shape, a rectangular shape, a pentagonal shape, a hexagonal shape, or other polygonal footprint. The dish-shaped regions 37 may also occupy a greater surface area than the recessed regions 39. Alternatively, the size of the recessed may be enlarged such that the recessed regions 39 collectively occupy a larger surface area relative to the surrounding dish-shaped regions 37. Plate 30 of FIG. 5 includes eight recess/dishing features for controlling the light emitted from the underlying light-emitting components. The number and location of these features may generally depend on the formation and pattern of the underlying light-emitting components. Thus, plate 30 may include more than eight recess/dish portions, less than eight recess/dish portions, three to ten recess/dish portions, five to eight recess/dish portions, or any suitable number of recess/dish regions.

Figure 6:
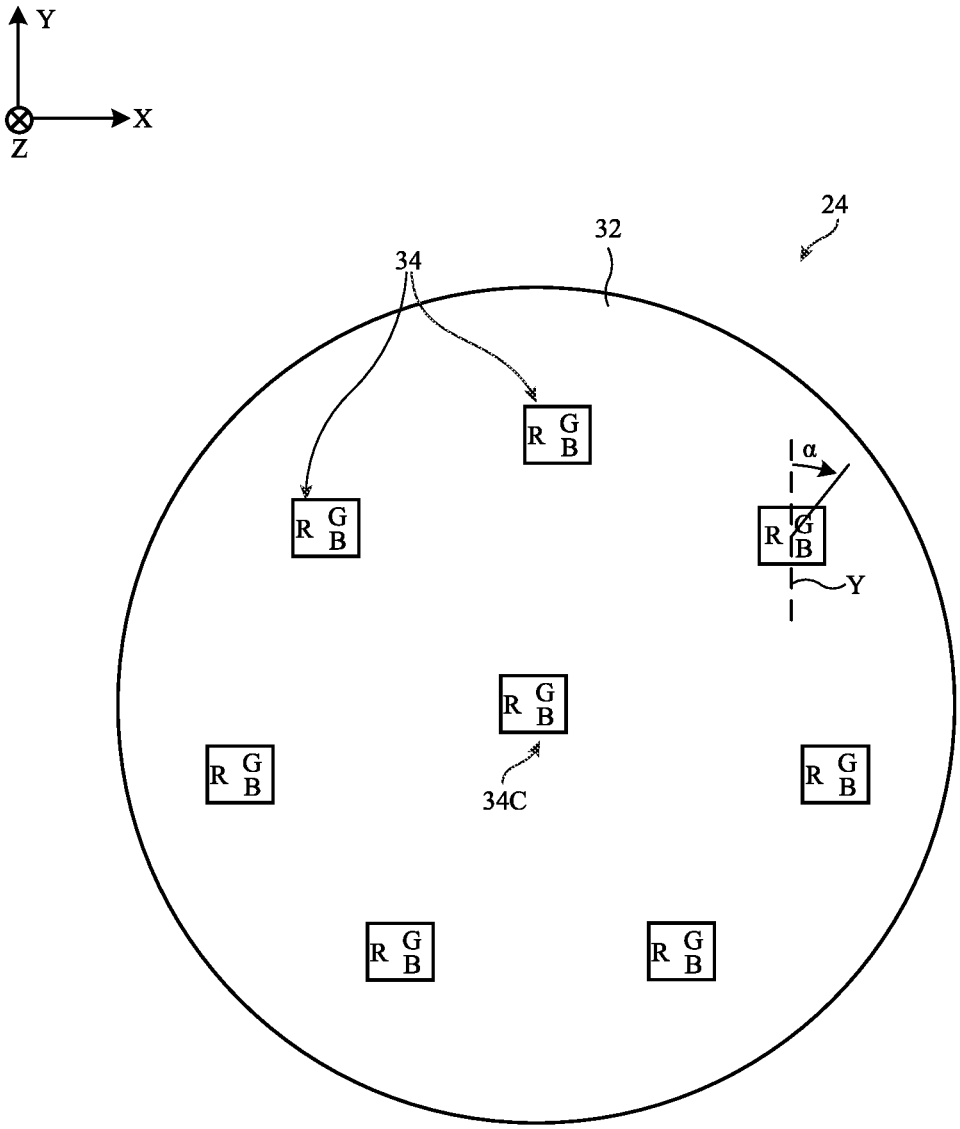
FIG. 6 is a top (plan) view of an array of light-emitting components in accordance with an embodiment.

FIG. 6 is a top (plan) view of the array of light-emitting components 34 mounted on printed circuit 32. Printed circuit board 32 may have an overall circular outline but may alternatively have an oval/elliptical footprint, a rectangular footprint, a triangular footprint, a diamond-shaped footprint, a pentagonal footprint, a hexagonal footprint, or other desired symmetrical or asymmetrical outlines. Any suitable pattern of light-emitting components 34 may be distributed across the surface of PCB 32. The distance between each adjacent pair of light-emitting components 34 may be equal or different. FIG. 6 shows eight total light-emitting components 34 as part of the visual feedback light-emitting device 24 but this is merely illustrative. If desired, printed circuit 32 may be provided with less than eight light emitting components (e.g., diodes of lasers), more than eight light-emitting components, 3-10 light-emitting components, 10-20 light-emitting components, 20-30 light-emitting components, more than 30 light-emitting components, or any suitable number of light-emitting components.

In some configurations, all of the light-emitting components 34 on the printed circuit 32 may be oriented in the same way. As described above, each light-emitting component 34 may include a red (R) subcomponent, a green (G) subcomponent, and a blue (B) subcomponent. If care is not taken, the light-emitting components may generate a visual output that is not color balanced. For instance, if all the light-emitting components 34 are oriented in the same way as the center light-emitting component 34C (where the red subcomponent is always facing west), then then the visual output may have a more reddish bias towards the west.

To improve color balance, at least some of the light-emitting components 34 in the array may be rotated by an angle $\alpha$ with respect to the Y axis. In one suitable arrangement, every other light-emitting component may be rotated by an angle $\alpha$ that is equal to 90°, 180°, 270°, 45°, 60°, 120°, 225°, 315°, or other suitable angle. For instance in the arrangement of FIG. 6, the center diode 34C may have a given nominal orientation while every other diode in the ring surrounding the center diode 34C may be rotated by an angle $\alpha$=180° relative to the given nominal orientation. By rotating at least some subset of the light-emitting components while keeping others oriented in the same way as the center diode 34C, improved color balance may be achieved. In yet another suitable arrangement, different groups of light-emitting components may be rotated by different respective amounts. For example, component 34 located along the 2 o'clock position might be rotated by an angle $\alpha$=30°, whereas components 34 located along the 5 o'clock position might be rotated by an angle $\alpha$=150°.

Figure 7:
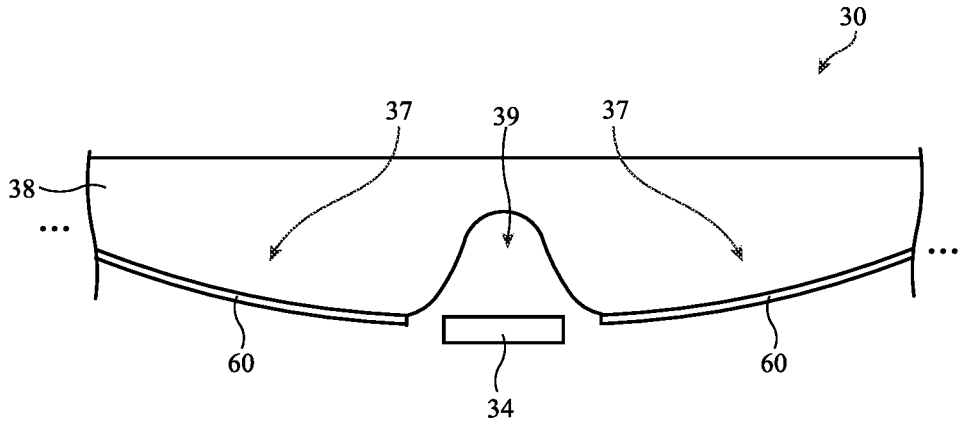
FIG. 7 is a cross-sectional side view of an illustrative light control plate having a transparent layer with an array of concave bell-shaped cavities and a reflective liner patterned at the bottom surface of the transparent layer in accordance with an embodiment.

The example of FIG. 2 in which light control plate 30 has an upper molded transparent layer and a lower molded reflective layer is merely illustrative and represents merely one way of configuring plate (structure) 30. FIG. 7 illustrates another suitable arrangement in which light control plate 30 includes a molded clear polymer layer 38 having a bottom surface that is selectively lined with a reflective coating 60. As shown in FIG. 7, layer 38 still includes bell-shaped recess 39 aligned with a respective underlying light-emitting component 34. Recess 39 may be surrounded by dish-shaped portion 37. The surface of the dish-shaped portion may be lined with the reflective coating material 60. Recess 39 should not be lined with the reflective coating material 60 so as to allow light emitted from component 34 to travel into layer 38 via the air cavity.

The reflective coating liner 60 may be patterned onto the dish portions 37 using a mask. Reflective liner 60 may be a layer of aluminum, gold, silver, copper, brass, bronze, other reflective metals, a white film (e.g., a layer of white paint), a dielectric mirror (e.g., a structure having relatively thin layers with a high refractive index interleaved with thicker layers with a lower refractive index), a distributed Bragg reflector (e.g., a reflector formed from multiple layers of alternating materials with varying refractive indices), a combination of these materials, or other suitable reflective film material. Reflective layer 60 may be formed at the bottom surface of clear layer 38 via physical vapor deposition (PVD), chemical vapor deposition (CVD), ion beam deposition, molecular beam epitaxy, sputter deposition, and/or other thin-film deposition methods.

Figure 8:
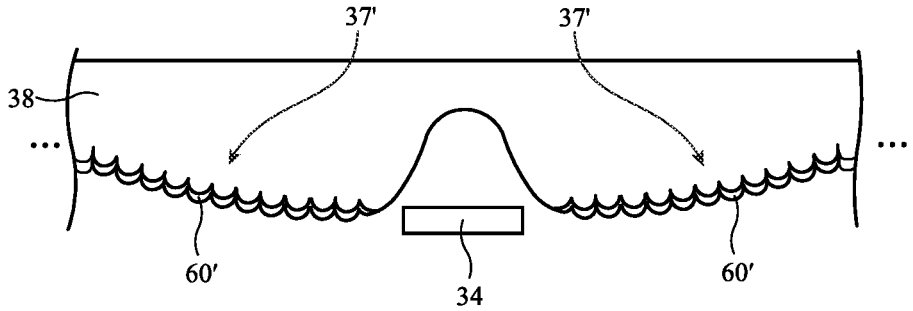
FIG. 8 is a cross-sectional side view of an illustrative light control plate of the type shown in FIG. 7 may have a microtextured bottom surface in accordance with an embodiment.

The example of FIG. 7 in which the bottom surface of the dish-shaped portions is a relatively smooth surface is merely illustrative. FIG. 8 illustrates another suitable arrangement in which the bottom surface of dish-shaped regions 37' is provided with microtextures configured to help diffuse light reflecting off of liner 60'. The use of a microtextured reflective surface can help scatter light while minimizing specular reflections. As shown in FIG. 8, the bottom surface of region 37' of layer 38 may have textured structures such as spherical structures, pyramidal structures, conical structures, frustoconical structures, ridges or other protrusions, and/or grooves, pits, or other depressions to help scatter light. These microtextured structures may be formed as integral structures when molding layer 38 or may be separately patterned via etching or other surface patterning or cutting processes. Reflective liner 60' may be patterned on the microtextured bottom surface of layer 38 via a mask using physical vapor deposition (PVD), chemical vapor deposition (CVD), ion beam deposition, molecular beam epitaxy, sputter deposition, and/or other thin-film deposition methods.

Figure 9:
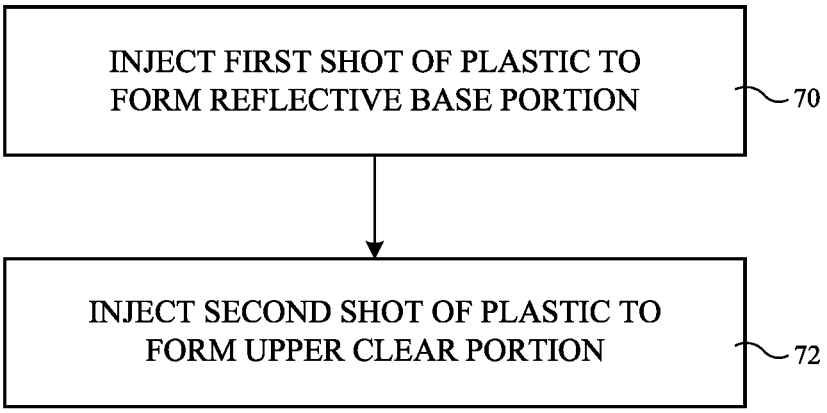
FIGS. 9 and 10 are flow charts of illustrative steps for forming the light control plate of FIGS. 2, 4, and 5 in accordance with some embodiments.
Figure 10:
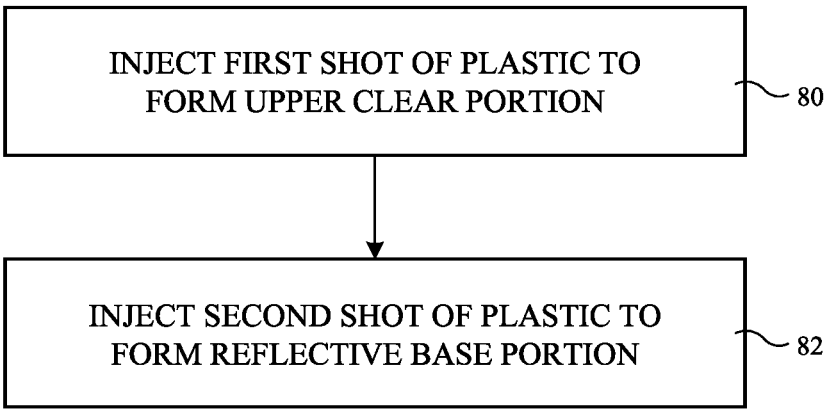

FIGS. 9 and 10 are flow charts of illustrative steps for forming the light control plate of FIGS. 2, 4, and 5 in accordance with some embodiments. One way of manufacturing light control plate 30 is using double-shot injection molding. In the example of FIG. 9, a first injection unit may be used to inject a first shot of plastic (e.g., white polymer, white resin, or other diffusive and reflective molding material) into a first mold cavity to form the reflective base layer 36 at step 70. The dish-shaped portions and the through holes for the recessed portions may be formed as integral parts of layer 36 during this step. If desired, the curved surface of the dish-shaped regions may be provided with microtextured structures to help scatter light and reduce specular reflections. At step 72, a second injection unit may then be used to inject a second shot of plastic (e.g., clear polymer, clear resin, or other transparent molding material) into a second over mold cavity to form the clear upper layer 38 on top of base layer 36. The clear plastic may fill the dish-shaped regions while the bell-shaped recessed portions are molded over the through holes in layer 36. Using dual-shot injection molding to manufacture light control plate 30 can help keep the thickness of plate 30 relatively small (e.g., the thickness of light control plate may be less than 4 millimeters, less than 3 millimeters, less than 2 millimeters, less than 1 millimeter, 1-5 millimeters, or other desired thickness), which helps minimize the overall optical stack of the visual feedback output device 24 within the housing of device 10.

FIG. 10 illustrates another suitable method of constructing light control plate 30 using two-shot injection molding. At step 80, a first injection unit may be used to inject a first shot of plastic (e.g., clear polymer, clear resin, or other transparent molding material) into a first mold cavity to form the clear upper layer 38. The dish-shaped portions and the bell-shaped cavity portions of layer 38 may be formed as integral parts of layer 38 during this step. If desired, the curved bottom surface of the dish-shaped regions may have microtextures to help scatter light and reduce specular reflections. At step 82, a second injection unit may then be used to inject a second shot of plastic (e.g., white polymer, white resin, or other diffusive and reflective molding material) into a second over mold cavity to form the reflective base layer 36. The reflective material may fill in or line the bottom surface of the dish-shaped portions during this step. Using dual-shot injection molding to manufacture light control plate 30 in this way can help keep the thickness of plate 30 relatively small (e.g., the thickness of light control plate may be less than 4 millimeters, less than 3 millimeters, less than 2 millimeters, less than 1 millimeter, 1-5 millimeters, or other desired thickness), which helps minimize the overall optical stack of the visual feedback output device 24 within the housing of device 10.

Device 10 may be operated in a system that uses personally identifiable information. The present disclosure contemplates that in some instances, data may be gathered that includes personal information data that uniquely identifies or can be used to contact or locate a specific person. Such personal information data can include demographic data, location-based data, telephone numbers, email addresses, twitter ID's, home addresses, data or records relating to a user's health or level of fitness (e.g., vital signs measurements, medication information, exercise information), date of birth, username, password, biometric information, or any other identifying or personal information.

The present disclosure recognizes that the use of such personal information, in the present technology, can be used to the benefit of users. For example, the personal information data can be used to deliver targeted content that is of greater interest to the user. Accordingly, use of such personal information data enables users to have control of the delivered content. Further, other uses for personal information data that benefit the user are also contemplated by the present disclosure. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the United States, collection of or access to certain health data may be governed by federal and/or state laws, such as the Health Insurance Portability and Accountability Act (HIPAA), whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, the present technology can be configured to allow users to select to "opt in" or "opt out" of participation in the collection of personal information data during registration for services or anytime thereafter. In another example, users can select not to provide certain types of user data. In yet another example, users can select to limit the length of time user-specific data is maintained. In addition to providing "opt in" and "opt out" options, the present disclosure contemplates providing notifications relating to the access or use of personal information. For instance, a user may be notified upon downloading an application ("app") that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data at a city level rather than at an address level), controlling how data is stored (e.g., aggregating data across users), and/or other methods.

Therefore, although the present disclosure broadly covers use of information that may include personal information data to implement one or more various disclosed embodiments, the present disclosure also contemplates that the various embodiments can also be implemented without the need for accessing personal information data. That is, the various embodiments of the present technology are not rendered inoperable due to the lack of all or a portion of such personal information data.

The foregoing is merely illustrative and various modifications can be made to the described embodiments. The foregoing embodiments may be implemented individually or in any combination.

What is claimed is:

1. An electronic device, comprising:

a housing;

a speaker in the housing;

light-emitting components configured to project light patterns onto a portion of the housing; and a light control plate between the light emitting components and the portion of the housing, wherein:

the light control plate comprises a clear upper layer and a reflective lower layer; and the clear upper layer comprises recesses each of which has a portion with a concave downward surface aligned with a respective one of the light emitting components.

2. The electronic device of claim 1, wherein the electronic device operates as a voice-controlled speaker device and wherein the housing is cylindrical and further comprises a fabric portion through which the speaker emits sound.

3. The electronic device of claim 1, wherein the portion of the housing is translucent.

4. The electronic device of claim 1, wherein the clear upper layer comprises a clear polymer layer.

5. The electronic device of claim 4, wherein the reflective lower layer comprises a white polymer layer.

6. The electronic device of claim 1, wherein each of the recesses forms a bell-shaped cavity over a respective one of the light-emitting components.

7. The electronic device of claim 1, wherein the reflective lower layer comprises portions with a concave upward surface surrounding the recesses.

8. The electronic device of claim 7, wherein the light control plate further comprises microtextures at the concave upward surface configured to scatter light.

9. The electronic device of claim 1, wherein each of the recesses have a height greater than a thickness of the reflective lower layer.

10. The electronic device of claim 1, wherein the reflective lower layer comprises a metal liner.

11. The electronic device of claim 1, further comprising:

a light diffuser layer between the light control plate and the portion of the housing.

12. The electronic device of claim 11, further comprising:

a clear layer between the light diffuser layer and the portion of the housing, wherein the clear layer and the diffuser layer are separated by an air gap.

13. The electronic device of claim 1, wherein the light control plate comprises a dual-shot injection molded structure having a thickness less than 3 millimeters.

14. An electronic device, comprising:

a housing;

a speaker within the housing:

light-emitting components configured to emit light through a top portion of the housing; and a light control plate having a clear upper layer and a reflective lower layer, wherein:

at least some of the light emitted from the light-emitting components travel directly through the clear upper layer towards the top portion;

at least some of the light emitted from the light-emitting components is reflected back from a top surface of the clear upper layer via total internal reflection; and at least some of the light reflecting from the top surface of the clear upper layer is reflected off an interface between the clear upper layer and the reflective lower layer back towards the top portion.

15. The electronic device of claim 14, further comprising:

a light diffusing layer between the light control plate and the top portion, wherein the top portion comprises a translucent polymer layer.

16. The electronic device of claim 14, wherein the clear upper layer has downward facing curved surfaces configured to directly receive light from the light-emitting components.

17. The electronic device of claim 16, wherein the interface is concave upward.

18. The electronic device of claim 14, wherein the clear upper layer comprises a transparent molded polymer layer, and wherein the reflective lower layer comprises a reflective co-molded polymer layer.

19. An electronic device, comprising:

a housing with a top portion;

a speaker within the housing;

light-emitting components configured to emit light; and a light control structure configured to spread the light emitted from the light-emitting components across the top portion, wherein the light control structure has a reflective molded portion and a clear molded portion on the reflective molded portion and wherein the clear molded portion has curved surfaces separated from the light-emitting components by a plurality of gaps.

20. The electronic device of claim 19, wherein the clear molded portion is formed by injecting a first shot of polymer and wherein the reflective molded portion is formed by injecting a second shot of polymer after the first shot.

21. The electronic device of claim 19, wherein the reflective molded portion is formed by injecting a first shot of polymer and wherein the clear molded portion is formed by injecting a second shot of polymer after the first shot.

22. The electronic device of claim 19, wherein each gap in the plurality of gaps has a concave downward portion with a center aligned to a respective one of the light-emitting components.

23. The electronic device of claim 22, wherein an interface between the clear molded portion and the reflective portion forms a concave upward surface configured to reflect light coming from an upper surface of the clear molded portion.

* * * * *